United States Patent [19]

Sachetto et al.

[11] Patent Number: 4,579,595

[45] Date of Patent: Apr. 1, 1986

[54] METHOD FOR HYDROLYZING CELLULOSIC MATERIALS INTO REDUCING SUGARS

[75] Inventors: Jean-Pierre Sachetto, Saint-Julien en Genevois, France; Jean-Michel Armet, Onex; Ake A. Johansson, Meyrin, both of Switzerland; Alain Roman, Bossey, France; Sergio Cuccolo, Geneva, Switzerland

[73] Assignee: Battelle Memorial Institute, Columbus, Ohio

[21] Appl. No.: 734,807

[22] PCT Filed: Oct. 27, 1981

[86] PCT No.: PCT/EP81/00171

§ 371 Date: Jul. 16, 1982

§ 102(e) Date: Jul. 16, 1982

[87] PCT Pub. No.: WO82/01723

PCT Pub. Date: May 27, 1982

Related U.S. Application Data

[63] Continuation of Ser. No. 403,734, Jul. 16, 1982, abandoned.

[30] Foreign Application Priority Data

Nov. 20, 1980 [CH] Switzerland ..... 8588/80

[51] Int. Cl.[4] ..... C13K 1/02

[52] U.S. Cl. ..... 127/37; 127/1

[58] Field of Search ..... 127/37, 1

[56] References Cited

U.S. PATENT DOCUMENTS

| | | | |
|---|---|---|---|
| 1,511,786 | 10/1924 | Terrisse et al. | 127/37 |
| 1,806,531 | 5/1931 | Gogarten et al. | 127/37 |
| 2,474,669 | 6/1949 | Hereng | 127/37 |
| 3,251,716 | 5/1966 | Porter | 127/37 |
| 4,292,089 | 9/1981 | Reghault et al. | 127/37 X |

FOREIGN PATENT DOCUMENTS

| | | |
|---|---|---|
| 354820 | 8/1931 | United Kingdom . |
| 341501 | 1/1937 | United Kingdom . |

OTHER PUBLICATIONS

Chemisches Zentralblath, vol. 139, No. 6, 2-7-68, Kusama et al., Abstracts 3045-3051.

*Primary Examiner*—Kenneth M. Schor
*Attorney, Agent, or Firm*—Kenneth R. Warburton

[57] ABSTRACT

A moist ligno-cellulosic mass was impregnated under cooling with HCl gas then it was warmed up in order to cause said mass to hydrolyze and the excess of acid to escape, the brewing action consecutive to said desorption improving the efficiency of said hydrolysis.

12 Claims, 2 Drawing Figures

METHOD FOR HYDROLYZING CELLULOSIC MATERIALS INTO REDUCING SUGARS

This application is a continuation of application Ser. No. 403,734 filed July 16, 1982 and now abandoned which was the confirmation PCT designated national filing of the International Application Ser. No. PCT/EP81/00171, filed Oct. 27, 1981.

The present invention concerns a method for hydrolyzing cellulose and ligno-cellulosic products (wooden chips, sawdust, chopped straw, various vegetal refuses, etc . . . ) into monomeric sugars by means of hydrochloric acid.

BACKGROUND OF THE INVENTION

There exists already a rather large number of techniques for hydrolyzing cellulose to a minor or larger extent by means of hydrochloric acid in concentrated or diluted solutions. These methods, among which there can be mentioned the BERGIUS, HERENG, PRODOR and other processes are disclosed for instance in the following references. Wood Chemistry, Process Engineering Aspects (1965), NOYES DEVELOPMENT CORP., Park-Ridge, N.J. 07656 USA; U.S. Pat. Nos. 2,951,775; 2,959,500; 9,974,067; 2,752,270; 2,778,751; 2,945,777; 3,212,932; 3,212,933; 3,251,716; 3,266,933 and 3,413,189.

However, when one uses solutions of hydrochloric acid, he must use rather high weight ratios of HCl to cellulose which requires, to ensure that the operation is profitable, that means for recovering and recycling this acid be provided. Now, such means are de facto not economical because of the additional equipment involved and, besides, there is a consecutive increase of the corrosion problems in connection with the use of such acids. Hence, means have been sought to remedy these drawbacks by decreasing the total amount of HCl put into work and, as a consequence, to increase its concentration at sites very close to the fiber to be hydrolyzed. Thus, a method is disclosed in U.S. Pat. No. 1,806,531 (GOGARTEN et al) in which cellulose containing materials are saturated with dry HCl (in compressed or liquid form) below zero degree C under pressure in an autoclave whereby decomposition of the material occurs at a temperature of 0° C. or below. Then, steam is introduced into the mass for raising the temperature to about 60°–75° C. and for effecting the saccharification of the decomposed cellulosic product. This method is economically interesting in some aspects since it uses a relatively low HCl cellulosic product weight ratio and also enables to recover part of this acid in highly concentrated form after saccharification. However, this advantage is offset by the necessity to use pressure equipment which is extremely difficult and costly to operate in the presence of compressed gaseous or liquid anhydrous HCl because of corrosion problems. Another disadvantage is that the addition of steam (i.e. a raise in temperature to relatively high values) is known to cause the decomposition of the sensitive sugars formed from wood, namely the pentoses which then turn into a black resin. Another disadvantage is the requirement that the solid comminuted cellulosic material in the autoclave be cooled to zero degree C. or below which is not easy to achieve in all cases and, more particularly, when using rotating pressure equipment. Finally, operating the decomposition of the cellulosic material at low temperatures such as 0° C. or below is not efficient since then the reaction rate is very slow and mixing is very poor as the cold mixture of HCl and cellulosic material is very stiff.

In another reference, i.e. U.S. Pat. No. 1,677,406 (PERL), there is disclosed a method for the saccharification of cellulose bearing products in which some of the above drawbacks are avoided. In this method, the cellulose product (wood chips) is progressively driven in a helical conveyor while a refrigerated mixture of dry HCl and a carrier gas is fed at counter-current relative to the displacement of the cellulose from the downstream side of the conveyor. The gases continuously travel through the conveyed material whereas the HCl is progressively adsorbed therein and the exhausted gases are then removed from the conveyor, replenished with fresh HCl and recycled in the system. This arrangement enables to have the fresh gases (with high HCl concentration) to first meet the material with the highest HCl saturation which minimizes undesirable local temperature jumps due to the heat produced by the dry HCl interacting with the fiber. This method is attractive but suffers from several drawbacks which prohibit profitable industrial application. Such drawbacks are, for instance, the extreme complexity of the mechanism of drive and valves for accurately controlling the moving of the comminuted solid and the concentration of gases at all stages of the process, both factors which are intimately interdependant, the required presence of very efficient carrier gas coolers which are not economical to run, the requirement to maintain moving parts under gas tight conditions since the equipment must operate under positive gas pressure (HCl gas is very corrosive to joints) and the rate of the overall reaction that will be relatively slow because of gas dilution as compared with methods using undiluted HCl gas.

In another method, the CHISSO process (Chemical Economy and Engineering Review II (6) (1979), 32), cellulose or wood particles, preferably prehydrolyzed with diluted acid, are impregnated with concentrated aqueous HCl solution until the water content of the mass is from 50% to 70% by weight, then, with the knowledge that the saturation concentration of an aqueous solution of HCl is inversely proportional to temperature, said mass soaked with aqueous acid is treated, below 10° C., with a current of HCl gas for increasing the HCl concentration in the solution until the cellulose of the impregnated mass will dissolve (indeed, the cellulose only dissolves significantly in HCl solutions when the concentration of HCl therein is or exceeds 39% by weight). Then, the whole material is heated to 35°–50° C. for effecting the hydrolysis of this cellulose in a relatively short time of 10 to 30 minutes. In the course of this heating, it is necessary to add some more water to compensate for the evaporation losses in the mass during the hydrolysis in which hydrosoluble oligomer polysaccharides are formed. Then, the excess of acid is separated by means of a current of hot air or HCl and recovered, the operation being performed as quickly as possible to minimize some possible decomposition of the monomeric sugars already made free during the said hydrolysis. Finally, there is added a relatively large volume of water to the mass for dissolving it completely and for carrying out the post-hydrolysis of the oligosaccharides into monomeric sugars, such post-hydrolysis being effective only in a solution of relatively low acid concentration (about 1–5%).

Such a method indeed enables to significantly reduce the quantity of acid put into operation relative to the older methods. It however presents some disadvantages which should be desirably remedied and which are as follows:

(a) the cellulosic materials should preferably be prehydrolyzed before saccharification by gaseous HCl; indeed, it is preferable to eliminate beforehand the pentoses which are easily separated by hydrolysis with diluted acid to prevent them from being possibly decomposed at the highest temperatures of the above-mentioned range (50° C.), (b) the mass should be impregnated beforehand with concentrated acid solution prior to the treatment with gaseous HCl. Thus, it is not possible to completely avoid the initial use of concentrated aqueous HCl solutions, (c) the obligation to compensate by a further addition of water the losses due to evaporation during the hydrolysis operation at 35°–50° C. is an undesirable complication, (d) the recovery of the gaseous acid is unseparable from some decomposition of the reducing sugars; this decomposition is slight but still significant at the temperature prevailing during this recovery.

SUMMARY OF THE INVENTION

The present invention, which involves no recycling of concentrated HCl solution, remedies practically all the above-discussed disadvantages. As in the prior art, this method intended for hydrolyzing cellulose or other cellulose containing products into sugar monomers by means of hydrochloric acid involves the following steps:

(a) one impregnates at a relatively low temperature (i.e. a temperature sufficiently low for ensuring that the rate of hydrolysis is still unsignificant thus preventing unexpected local overheating and possible decomposition of the product) a humid comminuted mass of cellulose or cellulose containing matter with gaseous HCl so as to cause the water contained in this mass to get progressively saturatively loaded with hydrochloric acid;

(b) one heats the mass thus impregnated for triggering a first hydrolysis reaction leading to the conversion of the said mass into oligosaccharides and other reducing sugars;

(c) one removes part of the acid in the form of gas for the purpose of its recovery; and (d) one adds to the mass thus prehydrolyzed an amount of water sufficient to complete the hydrolysis and he heats to convert the available oligosaccharides into monomeric sugars. The method of the invention however distinguishes from the prior-art by the following fundamental difference: the temperature at which the first hydrolysis is started is very close to 30° C., i.e. only slightly above or below said value (e.g. comprised between 28° and 33° C.). Thus, when heated (or allowed to come) to this temperature, the excess of HCl gas having been added under cooling to the water of the mass, this being for instance up to saturation, escapes therefrom in the form of microbubbles thus providing a "brewing" action that considerably improves the efficiency of the hydrolysis operation during which cellulose is converted into oligosaccharides and which can be thus carried out with an excellent yield and at a relatively moderate temperature even in the case of a material not prehydrolyzed and not delignified beforehand. In practice, one can either maintain the temperature between about 30° and 33° C. or, after the reaction has started together with the above mentioned gas evolution, he can heat to a higher temperature (particularly in the absence of the decomposable pentoses, i.e. when using a starting cellulose from which the hemicellulose has been removed beforehand) so as to further accelerate the first hydrolysis step. In these conditions, this hydrolysis can be accomplished within a period comprised between a few minutes and about 2 hrs. If pentoses are present, the hydrolysis temperature will preferably not exceed about 40° C.; in the absence of pentoses, the temperature can go higher, e.g. to 70° or even 80° C. although at the higher end of this range hexoses are also subject to some degree (not too much, fortunately) of decomposition (dark resins). It is noted that, during this hydrolysis, the oligosaccharides formed dissolve, all or in part depending on the water available in the mass, in the acid solution with which the latter is impregnated thus forming highly concentrated solutions, for instance of the order of 500 g/l, the total of the hydrosoluble dissolved and not dissolved substances being actually susceptible to be still much higher, e.g. 1000 to 1500 g/l.

It is besides possible in the present method to use non-prehydrolyzed ligno-cellulose such as wood chips or other comminuted ligno-cellulosic materials (chopped straw, bagasse, corn cobs, rice chaff, etc . . . ) which considerably broadens its operating range with regard to older methods. Further, the moisture content of this starting material can be sigificantly lower than in the CHISSO Process, for instance, comprised between 30 and 50% or below, as in the case of prepurified cellulose, namely delignified cellulose as disclosed in Swiss Patent Application No. 4.737/80-0. Moreover, it is in no way necessary in the present method to use any HCl solution to soak the fiber before treating with gaseous HCl as described for the above-mentioned process.

In regard to the temperature of impregnation with gaseous HCl, the values must naturally be lower than that for starting the first hydrolysis operation, that is to say below 30° C., being known that a saturated water solution of HCl has a concentration of 39% by weight around 30° C. which is the lowest possible concentration that is still operative for such a dissolution in the hydrolysis of cellulose. Preferably, the impregnation operation will be carried out between 0° and 20° C., for instance between 8° and 12° C. Although one can, if desired, operate at lower temperatures, this is not particularly desirable in view of the technical problems related to the cooling of apparatuses below zero °C., e.g. additional energy consumption, icing of the external part of the equipment, poor refrigerating efficiency in the case of pulverulent solids, etc . . . For this reason, running tap water (8°–12° C.) circulating in a mantle or in a cooling coil is an economical possible cooling means. Low temperature cooling liquids, e.g. brine, can also be used for increasing cooling rates provided, however, that the temperature at the reaction site, i.e. within the mass to be hydrolyzed, stay above 0° C. to avoid frost problems. Anyway, it is perfectly suitable to work at such temperatures in the present invention as the concentration of acid that forms during impregnation of the cellulosic mass and adsorption of the HCl gas by the water of said mass is comprised between 39% and the value corresponding to saturation at the temperature at which said impregnation is effected.

It should be remarked that, despite the very high concentration of the solutions which form under cooling during said impregnation operation, substantial HCl savings are achieved since the amount of water present (moisture in the mass) is relatively little. It was indeed calculated that, with a mass containing only 30% of humidity, the quantity of HCl put into work is of so little importance that, in principle, there would be no need to recover said acid as the process is still profitable despite such a loss. However, preferably, such recovery is effected and, contrary to the teaching of the CHISSO process described above, it is possible to work at a relatively low temperature and under reduced pressure. Thus, for achieving this recovery, one subjects the mass resulting from the first hydrolysis and which, although originally solid, has acquired a frangible and doughy consistency to a pressure of the order of 20 to 30 Torr so as to cause a new evolution of gaseous HCl. This degassing is continued until the solution of HCl with which the hydrolyzed mass is impregnated will reach the concentration of the water-HCl azeotrope, i.e. an HCl strength of 23–24% by weight under 20–30 Torr. The gaseous HCl thus recovered is recycled in the process, i.e., after pumping, it is reintroduced into the mass to be impregnated together with the main HCl gas stream. Naturally, such degassing can also be performed at reduced pressures different from 20–30 Torr, said operative pressures being only indicative and actually dependant on the degassing temperatures.

Regarding the post-hydrolysis operation, i.e. the end conversion of the oligosaccharides into monomeric sugars, it is effected in a dilute solution. In the course of working the invention, a quantity of water sufficient to dissolve all the oligosaccharides formed is added to the degassed mass resulting from the first hydrolysis step, the concentration of dissolved solids in the solution thus obtained preferably not exceeding 200 g/l and the acid strength of this solution being aproximately 0.1 to 5%. Then, this solution is heated preferably to the boil from a few minutes to several hours, the lignin and other insolubles (mineral salts, etc . . . ) are filtered out and the solution is treated by usual means for separating, if necessary the glucose and the other sugar monomers in a nearly quantitative yield. It is remarked that the total amount of acid involved in this terminal hydrolysis is relatively small and that the discarding of this acid (the recovery of which is, in general, not useful) is of no economical importance.

The embodying of the method of the invention can be easily done, on the small scale, by means of common laboratory glassware, e.g. a column with a mantle for refrigeration, glass flasks for holding the products, fritted plug tubings for the introduction of HCl, etc . . . .

For larger scale embodiments (semi-works or industrial set-up) there can be used an installation which is schematized on the annexed drawing.

DETAILED DESCRIPTION OF THE DRAWINGS

Figure 2:
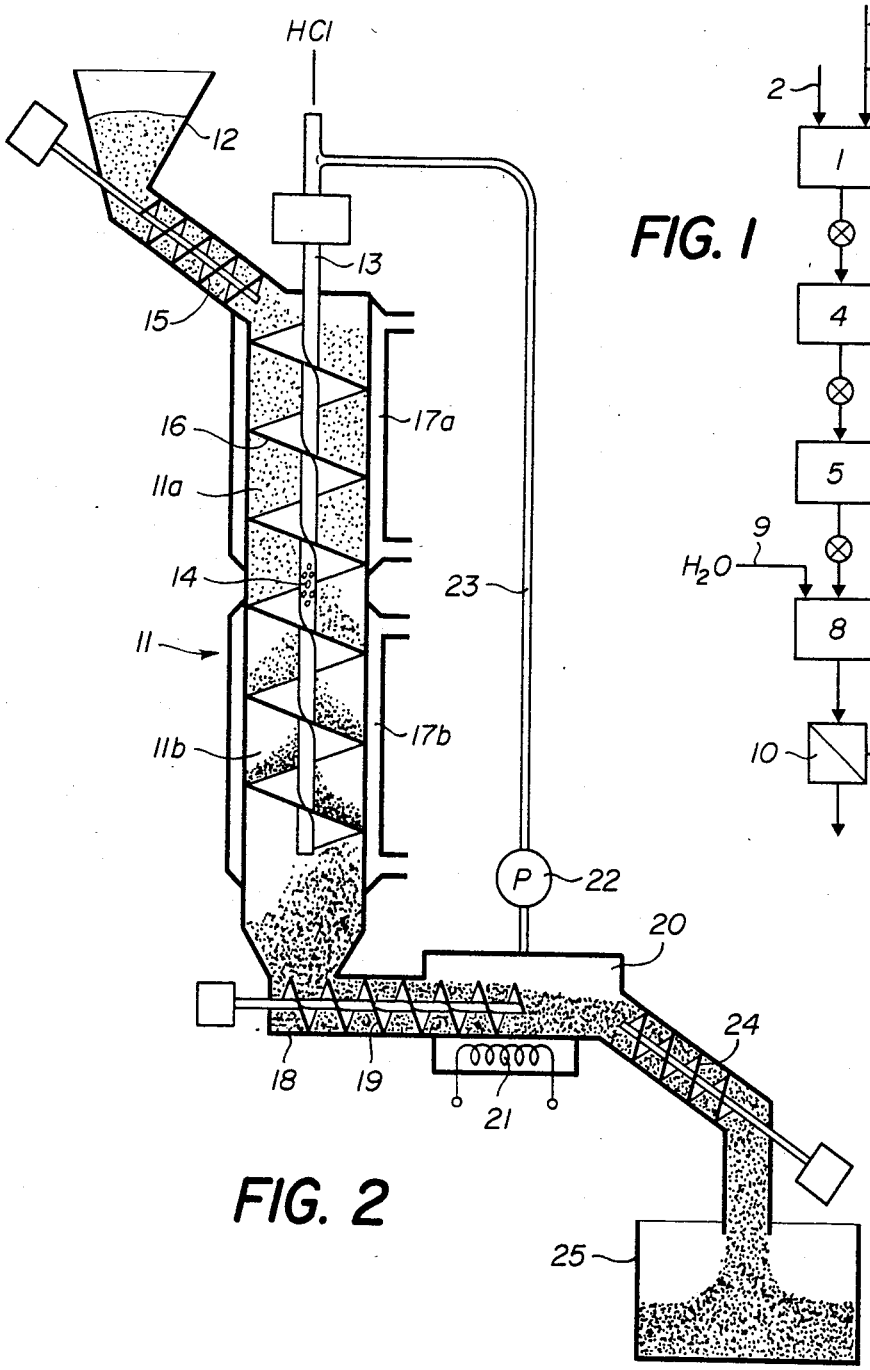
FIG. 2 is a partial schematic view of a semi-industrial installation for the saccharification of wood or other cellulose containing materials.
Figure 1:
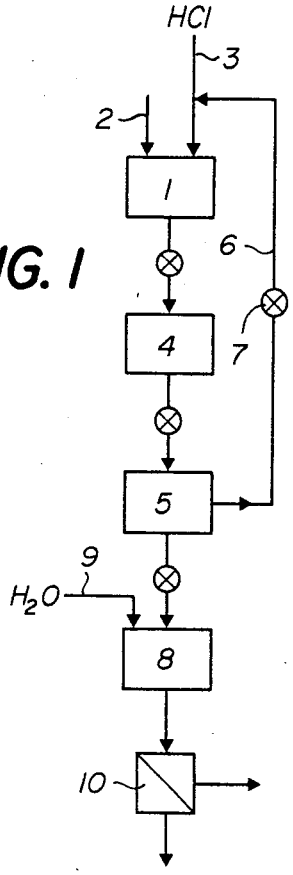
FIG. 1 is a block-diagram for schematizing the successive steps of the method of the invention.

The diagram of FIG. 1 encompasses a series of blocks representing schematically the various steps of the method and, consequently, the different operating sections or contrivances involved in the installation of FIG. 2. Thus, there is represented a first compartment 1 in which converge two conduits 2 and 3 which constitute the inlet for the vegetal material to be hydrolyzed and for the gaseous HCl, respectively. In this compartment 1, the moist vegetal material is impregnated under cooling with gaseous HCl up to a point where about 39–45% by weight of HCl has dissolved in said moisture. Then, the matter thus impregnated is transferred into a second compartment where it is heated around 30° C. or more and in which the first hydrolysis into a mixture of monomers and oligomers is carried out, said operation being activated by the degassing phenomenon ("brewing" under the action of micro-bubbles evolution) previously mentioned. In this compartment 4, the strength of the acid in the water involved decreases to about 38–39% by weight, or less if the heating exceeds 33° C., and the mass shrinks and become doughy while the escaped gas is returned to compartment 1. Then, the mass is moved to an enclosure 5 for carrying out most of the degassing and wherefrom the excess of HCl gas is expelled and returned to conduit 3 by means of a pipe 6 and a pump 7. Finally, the degassed paste is sent to a compartment 8 in which, after addition of water in 9, there is effected the post-hydrolysis of the oligosaccharides into sugars, the solution of the latter being finally sent to a separator 10 wherein the separation of the insolubles (lignin, etc . . . ) and the purification of said sugars is carried out.

The installation of FIG. 2 comprises, the implements being described in the same order as above, a reactor 11 including an upper compartment **11*a* and a lower compartment 11*b* supplied with vegetal material by means of a hopper 12 and with gaseous HCl by means of an axial tubing 13 the lower end of which is closed but the side-wall of which at the level situated between compartments 11*a* and 11*b* is provided with a plurality of pores or holes 14 intended for homogeneously dispensing the HCl in said upper compartment. The reactor 11 further comprises the following components: a feed screw 15, a spiral 16 for progressively displacing the vegetal material in the reactor from top to bottom, this spiral being axially supported by the tube 13, and mantles 17*a* and 17*b* for controlling, by means of a liquid circulated therein, the respective temperatures of compartments 11*a* and 11*b*. The lower part of reactor 11 is connected by a duct 18 provided with a transfer worm 19 for conveying the hydrolyzed paste into a degassing chamber 20, the temperature thereof being under control from a heating element 21. The pressure in the chamber 20 is controlled by a pump 22 which sucks the evolved HCl gas and, in case of recycling, sends it into the reactor by a pipe 23. Finally, the degassed material is discharged by a worm 24 and it is collected in a tank 25 wherefrom it is transferred to the post-hydrolysis container not represented on the drawing. It will be noted that transfer worms 19 and 24 also provide gas tightness to the chamber 20, i.e. they ensure that the low-pressure from the pump 22 (of the order of 20–30 Torr) be limited to said chamber 20**.

The operation of the present installation becomes self-evident from the above description: thus, the vegetal material introduced into the upper compartment 11*a* of the reactor 11 by means of feed screw 15 is subjected to the cooling effect of a cooling medium, e.g. a liquid circulated in the mantle 17*a* (for instance tap water at 12° C. or refrigerated brine if lower temperatures are desired). Simultaneously, gaseous HCl is introduced by means of tubing 13 and is regularly delivered though the holes 14 for impregnating the vegetal mass in compartment 11*a*. Then the mass thus impregnated is progressively transferred into compartment 11*b* where it is warmed up, for instance to 30° C. or more by means of a heating liquid circulated in mantle 17*b;* in this compartment, the mass will lose with bubble formation part of its HCl gas and will simultaneously hydrolyze which causes it to contract and partially liquefy as a viscous paste; one has attempted in the drawing to suggest this sequence of events by representing the wood particles as progressively agglomerating when the mass is moving downwards in the reactor. It should be remarked that the HCl which evolves at this stage is not lost since it escapes upwards and penetrates the upper compartment whereby it contributes to the impregnation of the still new cellulosic mass therein. Finally, the mass consisting of oligosaccharides partially dissolved in acid, lignin and other solids is degassed in the chamber 20 and discharged with the worm 24 whereas the recovered HCl is recycled via line 23 by means of the pump 22. For compensating the cooling effect resulting from the evaporation of the HCl, the chamber 20 is warmed up by the heating element 21. Naturally, in a modification, this effect could also be achieved by using the calories taken up by the cooling liquid circulating in mantle 17*a*, for instance, directly or by mean of a heat exchanger. After discharge, the material is thereafter post-hydrolyzed in a classical reactor not represented and, if necessary, the solution is purified by usual means, for instance by passing over activated charcoal or ion exchange resins (anionic) for removing the organic or mineral impurities.

There will be still noted that, on FIG. 2, the means for driving the various transfer screws and worms for the vegetal mass are represented by blocks not numbered; these blocks can represent, of course, usual motors.

DESCRIPTION OF EXEMPLARY PREFERRED EMBODIMENTS

The Examples that follow illustrate the invention in more detail.

Example 1

In a double walled 300 ml glass column, there were placed 88 g of beech-wood chips with 49% by weight humidity (43 g of water for 45 g of dry matter). Tap water was circulated in the mantle of the column to bring the mass of chips to about 8°–10° C., after which it was saturated with HCl gas introduced at the bottom of the tube by means of a fritted pipe. The flow-rate of HCl was adjusted so that the heat produced by the dissolution of the gas in the water dispersed in the material be progressively removed by the cooling liquid and that the temperature therein stay at about 10°–12° C.; at such temperature, the rate of hydrolysis of the cellulosic material is still unsignificant and no visible degassing will occur. After about 1 hr, it was noted that the whole mass had darkened, such darkening having progressively caught from below and gone upwards in the course of saturation with HCl. There was also noted that gaseous HCl began to escape from the top of the column and, after stopping the gas flow, there was measured, by weighing, a weight increase of about 33 g which corresponds to the formation (on the basis of 43 g of water) to a hydrochloric solution of about 43.5%.

The cooling water was then replaced by some circulating water at 30° C. whereby the mass efferversced (bubbled) and contracted to a pasty material that fell and accumulated in the bottom of the column to a volume of about 50 ml. After 2 hrs at 30°, the acid strength had decreased to about 39%, as measured by weighing. The pressure was then reduced with the water pump, still at 30° C., for about ½ hr which caused another decrease in the acid strength of the impregnation solution down to 23–24% by weight.

The dark residue was then taken with 550 ml of water in order to bring the concentration of the remaining acid to about 2%, then the mixture was boiled (refluxed) for 1 hr to complete the hydrolysis into monomeric sugars. Then the solution was filtered after cooling which provided 1.35 g of solids (lignin+insoluble inorganic salts) and the solution was analyzed according to A. I. LISOV and S. V. YAROTSKII, Izv. Akad. Nauk. SSR, Ser. Khim. (4) 877–880 (1974) (colorimetric method involving o-toluidine). The results, calculated with reference to the volume of the solution, indicated the presence of a total of 6.75 g of pentoses and 23.85 g of hexoses (total 30.6 g) which corresponds, respectively, to 15% and 53% by weight, of the starting dry material.

Now, the composition of said dry material (beech-wood) is as follows: pentosanes 17%, cellulose 50% which provides, taking respectively into account first the molecular weights of the oxa-pyranose units from which the pentoses and hexoses originate hydrolytically and, second, the molecular weights of said sugars, the following quantities:

Pentoses: $45\times0.17\times150/132=8.69$ g

Hexoses: $45\times0.50\times180/162=25$ g

The hydrolysis yields are thus, respectively: $6.75/8.69=78\%$ pentoses and $23.85/25=95.4\%$ hexoses.

The quantity of gaseous HCl involved is the following if one considers that the fraction evolved during degassing when the temperature is raised from the impregnation temperature value to that of hydrolysis is saved (see the above description of the present semi-industrial installation): 43 g of starting water gave, after the first hydrolysis at 30° C., a solution at 39% by weight, i.e. 27.5 g of HCl $(27.5/(27.5+43)=0.39)$. The consumption of HCl by gram of sugar is therefore $27.5/30.6=0.9$ g/g. When recalculating this ratio after final degassing (and considering that the HCl evolved then is recycled), the value becomes 0.4 g HCl/g of sugar formed.

Example 2

In the same equipment as that used in the previous Example, there were treated 33.8 g of cellulose pulp (21 g of dry matter and 12.5 g $H_2O$) cleared of lignin by the method disclosed in Swiss application No. 4737/80-0. Operations were carried out under the same conditions of time and temperature as in Example 1 and there was also observed a darkening of the mass under the influence of the HCl and a volume shrinkage during the first hydrolysis of the order of 10 to 1.

After final degassing, the blackish mass was taken up in 485.5 ml of water (the theoretical volume of the acid of 22–23% being 14.5 ml) to obtain about 500 ml of an approximately 0.8% solution of acid. Then, after 2 hrs of boiling, 1.2 g of insolubles were filtered out and the sugars were analyzed as described above which provided 0.25 g of pentoses and 20.25 g hexoses. The composition of the starting dry material was as follows: pentosanes, about 2% i.e. 0.426 g or, under the form of pentoses, 0.484 g. Cellulose, 92.5% i.e. 19.7 g corresponding to a theoretical potential of 21.88 g glucose. Residual lignin, 5% (1.065 g). Ashes, 0.5% (0.106 g). The practical yield of hexoses was therefore 20.55/21.88=92.5%.

With the same calculation as for the previous Example, it was found that the consumption of HCl was 0.376 g/g of glucose before final degassing and 0.170 g of HCl/g glucose after said degassing.

Example 3

This example refers to the continuous hydrolysis of a cellulose pulp using an installation similar to that represented by FIG. 2.

Cellulose pulp (95% pure, 5% residual lignin with 30% moisture content) was continuously fed into a reactor 11 by means of a hopper 12 and a feed screw 15 at the rate of 142.86 kg/hr, i.e. 100 kg/hr of dry pulp. The pulp was displaced progressively in the reactor from top to bottom by means of a spiral 16. During the displacement of the pulp in the compartment 11*a* of the reactor, the pulp was cooled by circulating a refrigerating liquid (refrigerated brine) in the mantle 17*a*, so as to maintain the pulp in compartment 11*a* between about 15° and 20° C. Simultaneously, HCl gas was introduced into the mass through the holes 14 of tube 13. The flow rate of gaseous HCl entering the reactor was 28.57 kg/hr. At the outset of compartment 11*a*, the pulp was impregnated with a 45% by weight hydrochloric acid solution which means that 35.06 kg of 100% HCl was actually retained by the 142.86 kg of moist pulp. The reason for the difference between said 35.06 kg and the amount of acid actually supplied by tube 13 (28.37 kg), i.e. 6.49 kg, will be explained hereinafter.

The HCl loaded pulp entered compartment 11*b* wherein it was warmed up to 30° C. by warm water circulating in the mantle 17*b*. In this compartment some of the gaseous HCl departed from the pulp with effervescence thus producing a mixing effect that helped in the hydrolysis of the pulp that took place simultaneously, thus causing the partial liquefaction thereof; the partly liquefied pulp which left the reactor at bottom of compartment 11*b* still had a content of HCl of 40% which mean that 6.49 kg of gaseous HCl had evolved and accounted for the acid being recycled and additionally absorbed by the pulp as mentioned previously. The pulp with 40% HCl was transfered by the transfer worm 19 into the chamber 20 where it was degassed to a point where the acid concentration of the mass went to 21% HCl. During this degassing, 17.18 kg of hydrogen chloride was evolved and was sent back to the tubing 13 for recycling. Therefore, 11.31 kg of fresh hydrogen chloride had to be added to the 17.18 kg recycled to compensate for the same quantity of acid still in the hydrolyzed pulp discharged from chamber 20.

The hydrolyzed mass (159.81 kg/hr) transfered to the tank 25 where 479.95 kg/hr of water were added for dilution. Thus, the final composition (by weight) of the moisture prior to post-hydrolysis was the following:

| | |
|---|---|
| Potential glucose | 16.5% by wt |
| HCl | 2.13% |
| Residual lignin | 0.78% |
| $H_2O$ | 80.5% |

Post-hydrolysis was carried out for one hour at 100° C. The final yield of monomeric glucose content being in the range of 15.5% (total 175–176 g of sugars/liter) (post-hydrolysis yield 94%). The remaining sugars were identified as reversed glucose oligomers not completely hydrolyzed into glucose.

We claim:

1. A method for hydrolyzing a comminuted mass of non-acidified non-prehydrolyzed moist cellulose containing material or non-acidified, non-prehydrolyzed moist ligno-cellulosic materials into monomeric sugars by means of hydrochloric acid, which method consists essentially of:

(a) impregnating, while cooling to below 30° C., the comminuted mass with gaseous HCl in an amount so as to saturate water in said mass with hydrochloric acid, (b) heating the mass thus-impregnated to a temperature between 28° and 33° C. to thereby provide an evolution of and an effervescent discharge of gaseous hydrogen chloride which is recycled to provide at least a portion of the gaseous HCl for the (a) impregnating, and with said temperature being sufficient to initiate a first hydrolysis reaction so as to convert at least a portion of said mass into oligosaccharides, and with the evolution and the effervescent discharge being such that it will provide a mixing action of said mass and with the thus initiated first hydrolysis reaction being continued for such time and temperature so as to provide a shrunken material having a doughy consistency, (c) subjecting the shrunken material to reduced pressure conditions so that hydrochloric acid comes off in the form of gas, which gas is recycled as gaseous HCl to provide gaseous HCl for the (a) impregnating, and so that there remains a degassed mass, (d) adding water to the degassed mass and heating to complete hydrolysis so as to provide a solution of the monomeric sugars.

2. The method of claim 1 in which the (b) heating is to between 30° and 33° C., whereby thermal decomposition of pentoses liberated during said first hydrolysis will be essentially negligible.

3. The method of claim 2 in which the being continued first hydrolysis reaction in (b) is at the temperature between 30° and 40° C.

4. The method of claim 1 in which the comminuted mass is a moist non-prehydrolyzed cellulose.

5. The method of claim 1 in which the comminuted mass has a moisture content not exceeding 50% by weight.

6. The method of claim 1, in which said (a) impregnating is while cooling to between 0° to 20° C.

7. The method of claim 1, in which said (a) impregnating is while cooling to between 8° and 12° C.

8. The method of claim 1, in which the (a) impregnating is continued until the comminuted mass has been impregnated at the end of (a) so as to saturate said water therein with from about 45% to 39% by weight of HCl.

9. The method of claim 1 in which the comminuted mass is a cellulose containing material which liberates oligosaccharides and monomeric sugars, which at the end of (b) are dissolved to a concentration of 500 g/l or more per volume of liquid.

10. The method of claim 1 in which the conditions in (c) include reduced pressure and a temperature sufficiently low so as to avoid thermal degradation of pentoses present in the shrunken material and for a time sufficient to cause residual solution in said shrunken material to reach a concentration of the water/HCl azeotrope under said reduced pressure.

11. The method of claim 1 which includes in (d) the adding of a quantity of the water sufficient so as to provide a solution containing dissolved solids below 200 g/l and having an acid concentration between 0.1 and 5%.

12. The method of claim 11 in which in (d) the heating is to a boiling temperature.

* * * * *